US005816223A

United States Patent [19]

Jamrog et al.

[11] Patent Number: 5,816,223

[45] Date of Patent: Oct. 6, 1998

[54] EVAPORATIVE EMISSION CONTROL SYSTEM FOR PROVIDING FUEL TO VAPOR TO AUTOMOTIVE ENGINE

[75] Inventors: James Richard Jamrog, Novi; David Chester Waskiewicz, Livonia; Marianne L. Vykydal, Onsted, all of Mich.

[73] Assignee: Ford Global Technologies, Inc., Dearborn, Mich.

[21] Appl. No.: 998,637

[22] Filed: Dec. 29, 1997

[51] Int. Cl.[6] ..... F02M 33/00; F02D 31/00

[52] U.S. Cl. ..... 123/520; 123/357

[58] Field of Search ..... 123/357, 520, 123/519, 518, 516, 521

[56] References Cited

U.S. PATENT DOCUMENTS

| | | | |
|---|---|---|---|
| 5,111,796 | 5/1992 | Ogita . | |
| 5,230,319 | 7/1993 | Otsuka | 123/520 |
| 5,347,971 | 9/1994 | Kobayashi | 123/520 |
| 5,400,759 | 3/1995 | Ishida | 123/520 |
| 5,411,007 | 5/1995 | Narita | 123/520 |
| 5,460,143 | 10/1995 | Narita . | |
| 5,477,837 | 12/1995 | Ikebuchi | 123/520 |
| 5,592,923 | 1/1997 | Machida | 123/520 |
| 5,596,972 | 1/1997 | Sultan et al. . | |
| 5,606,955 | 3/1997 | Yuda | 123/520 |
| 5,617,832 | 4/1997 | Yamazaki et al. . | |
| 5,669,360 | 9/1997 | Hyodo et al. . | |
| 5,669,362 | 9/1997 | Shinohara et al. . | |

*Primary Examiner*—Carl S. Miller
*Attorney, Agent, or Firm*—Jerome R. Drouillard

[57] ABSTRACT

An engine controller tracks purge system pressure within a vapor line extending from a fuel tank to a carbon canister and, in the event that pressure changes at an unduly high rate, operates to restrict the purging of vapor from a carbon canister.

14 Claims, 2 Drawing Sheets

EVAPORATIVE EMISSION CONTROL SYSTEM FOR PROVIDING FUEL TO VAPOR TO AUTOMOTIVE ENGINE

FIELD OF THE INVENTION

The invention relates to a system for allowing fuel vapor arising within an automotive vehicle's liquid fuel system to be consumed by an engine without adversely affecting engine operation.

BACKGROUND OF THE INVENTION

Government regulations concerning the release into the atmosphere of various exhaust emission constituents from automotive vehicles are becoming increasing more stringent. As the stringency related to emissions of oxide of nitrogen, carbon monoxide, and unburned hydrocarbons, inter alia, becomes greater, it is becoming increasingly necessary to control the engine combustion process so as to avoid unnecessary instabilities. Of course, those skilled in the art know that not only engine tailpipe emissions are regulated, but also evaporative emissions. In point of fact, evaporative emission control is a very important consideration in automotive design and necessitates that fuel vapor arising from the engine fuel system be drawn into the engine and burned. Because the fuel vapor can be combusted by the engine, a discontinuous flow of vapor may cause combustion instability, or perhaps even engine roughness or stalling. The present system is intended to allow vapor to be processed and burned by an automotive engine without causing attendant instability problems.

U.S. Pat. No. 5,460,143 discloses an evaporative emissions control system in which a pressure transducer stops purging of a carbon canister in the event that fuel tank pressure falls to a negative value. The present system is intending to control purging not only when tank pressure goes to a negative value, but in response to rapid fluctuations in the tank pressure at a positive pressure or negative pressure, which may cause the air and fuel vapor entering the engine from the purge line of a carbon evaporative emissions control canister to upset the combustion process.

SUMMARY OF THE INVENTION

A system for providing evaporative fuel vapor to an automotive engine includes a liquid fuel storage tank having an outlet port for allowing fuel vapor to exit the tank, and a carbon canister for storing fuel vapor generated within the fuel tank. The carbon canister has an inlet port for receiving air and an outlet port. The outlet port is adapted for both receiving fuel vapor from the tank and acting as an outlet for a flow of stored fuel vapor and air when the canister is purged. A vapor line connects the tank outlet port and the outlet port of the carbon canister. A purge valve allows vapor to flow from the fuel tank and the outlet port of the carbon canister through the purge line and into the engine. A pressure transducer senses purge system pressure within the vapor line. Finally, a controller connected with the purge valve and the purge system pressure transducer tracks fuel vapor pressure within the vapor line within successive sample periods and operates the purge valve to restrict purging in the event that the time rate of change and the fuel vapor pressure exceeds a threshold value.

The controller determines the threshold value for the maximum allowable time rate of change of fuel vapor pressure as a function of the total mass of air flowing through the engine. In general, the greater the mass flow through the engine, the greater the ability of the engine to tolerate changes in the fuel content of the purge flow entering the engine from the carbon canister and fuel tank. The threshold value for the time rate of change of fuel vapor pressure is determined by the controller from a lookup table using a measured value for the total mass of air flowing through the engine as an independent variable.

According to another aspect of the present invention, a method for controlling the flow of evaporative fuel vapor to an automotive engine having a liquid fuel storage tank, in a system for conveying fuel vapor to the engine, includes the steps of establishing a vapor flow from at least one source of fuel vapor to the engine; periodically measuring a purge system operating pressure within the vapor conveying system; calculating the time rate of change of the measured purge system pressure; and adjusting the flow of vapor to the engine in the event that the calculated time rate of change of the purge system pressure exceeds a predetermined threshold. According to another aspect of the present method, the flow of vapor to the engine is terminated in the event a time rate of change of fuel vapor pressure exceeds a predetermined threshold. This threshold is based upon a measured flow of fuel through the engine or may be based upon a measured flow of air through the engine, or upon the percentage of fuel flowing through the engine which is furnished by the evaporative emission control system. The flow of vapor to the engine may be terminated for a variable period of time in the event that the rate of change of fuel vapor pressure exceeds a predetermined threshold, with the flow of vapor being reestablished after a variable period of time has run.

DETAILED DESCRIPTION OF PREFERRED EMBODIMENTS

Figure 1:
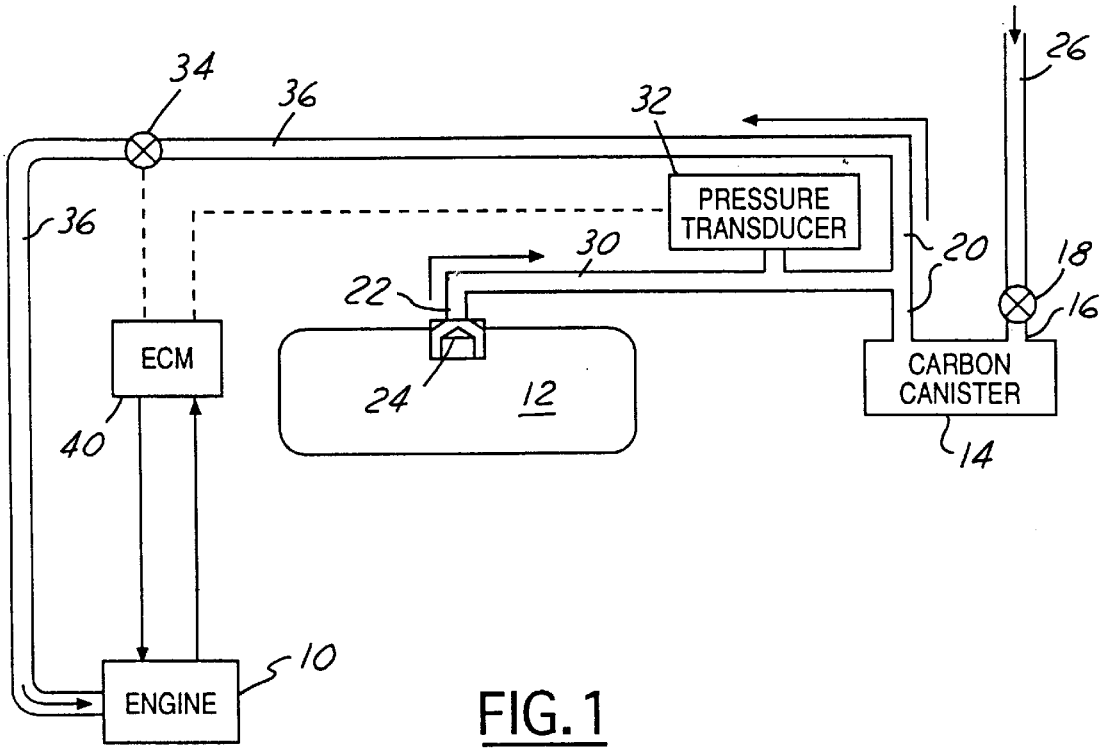
FIG. 1 is a schematic representation of an automotive engine having a fuel vapor venting and carbon canister purging system according to the present invention.

As shown in FIG. 1, automotive engine 10 receives fuel from liquid fuel tank 12. Vapor generated by fuel contained within fuel tank 12 and furnished to engine 10 is controlled by a system according to the present invention. Vapor leaving tank 12 past vapor vent valve 24 and outlet port 22 enters vapor line 30 before passing to outlet port 20 of carbon canister 14. During periods in which the vehicle is not being operated, fuel vapor is stored within carbon canister 14. When engine 10 is being operated, canister vent valve 18 is open and ambient air is drawn through purge air inlet 26, then through carbon canister 14 and through outlet port 20, and then through purge line 36 past purge valve 34 and into engine 10. Electronic control module (ECM) 40 which controls the rate of purging by operating purge valve 34, receives evaporative emission control (purge) system pressure information from pressure transducer 32.

Air drawn through carbon canister 14 causes desorption of fuel vapor stored in the canister; the fuel vapor and air flowing from canister 14 are combined with vapor from fuel tank 12.

During the vapor purging process, pressure transducer 32 is used to track the purge system pressure within vapor line 30. The purge system pressure may change for a variety of reasons. For example, the composition of the fuel and its temperature will affect pressure within vapor line 30. Slow changes in pressure are easily handled by conventional means which compensate for changes in air fuel ratio by detecting such changes by means of an exhaust gas oxygen sensor (not shown). The problem with relying solely upon an exhaust gas oxygen sensor to detect changes in the fuel content of the air and vapor entering the engine through purge line 36 is that the effect of the vapor entering into the combustion process cannot be known by the ECM 40 until the air fuel ratio sensor, which is downstream of the engine, shows a reaction. This may cause problems because the engine stability is already impaired by the time a change in the exhaust gas composition is noted or determined by an exhaust gas oxygen sensor.

Figure 2:
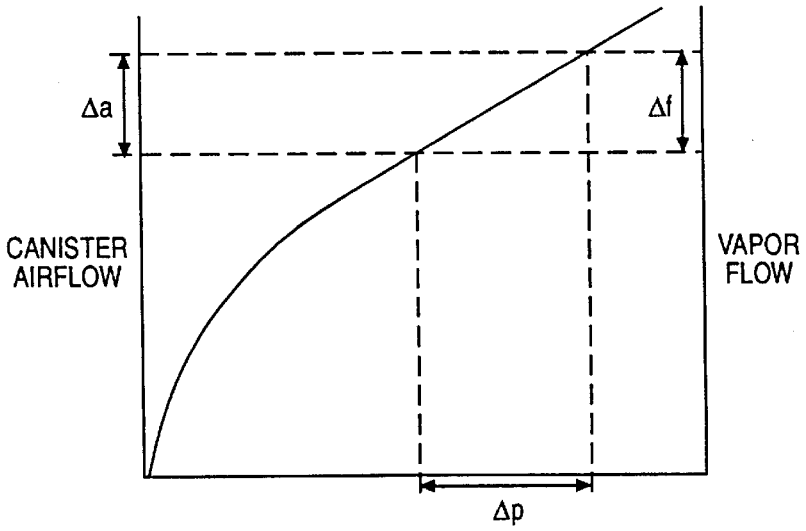
FIG. 2 is a plot of carbon canister air flow, equivalent vapor flow, and pressure drop of a system according to the present invention.

The present system relies on the phenomenon shown in FIG. 2 to prevent combustion instability by allowing immediate reaction to a change in the amount of vapor injected into the purge flow by fuel tank 12.

FIG. 2 illustrates carbon purge system air flow and fuel vapor flow as a function of pressure drop, as measured by pressure transducer 32. Note that for a given change in purge system pressure, Δp (on the abscissa), which indicates a change in the pressure measured by pressure transducer 32, corresponding changes Δa for purge air flow through carbon canister 14 and Δf, for inferred fuel vapor flow are shown. In other words, a change in purge system pressure measured by pressure transducer 32 corresponds to a change in vapor flow during the purging process. It is rapid changes in the measured pressure and hence in the mass flow of fuel vapor to engine 10 which the present system is intended to detect and compensate for.

ECM 40 is an engine controller of conventional type known to those skilled in the art and selected in view of this disclosure. As described above, controller 40 operates purge valve 34 and receives signals from pressure transducer 32. It has been determined that the ability of one engine to tolerate changes in the amount of fuel vapor flowing into the engine from the purge system is such that in the event that 15% or more of the fuel originates from the purge system, as opposed to the fuel injection system, a change of as little as 0.16", $H_2O$ in the purge system pressure should be handled by temporarily halting the purging process.

Figure 3:
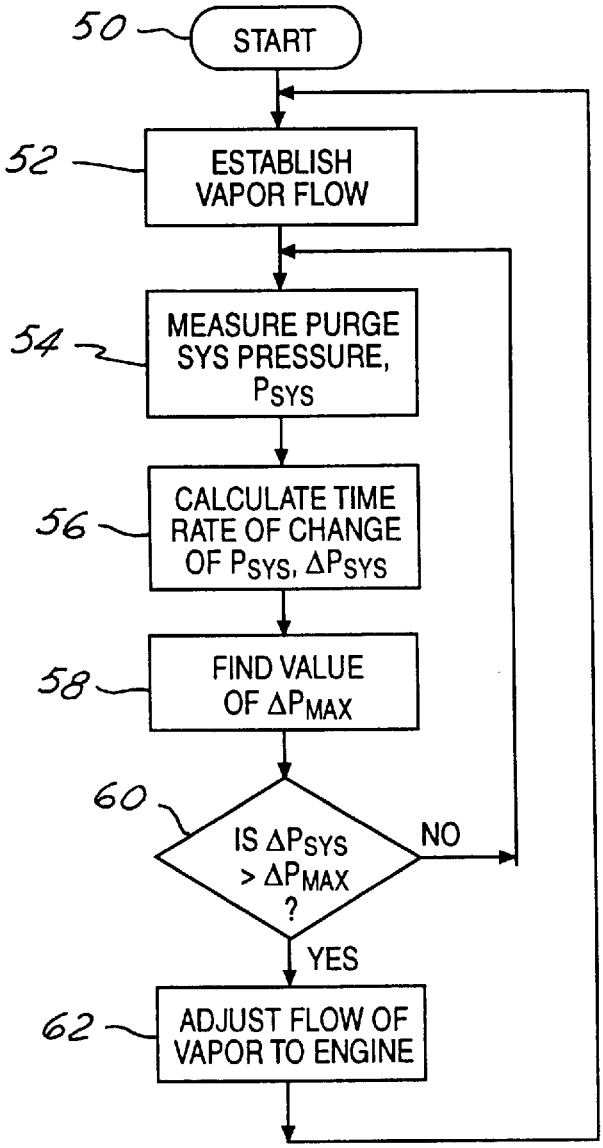
FIG. 3 is a flow diagram illustrating operation of a system according to the present invention.

FIG. 3 illustrates the function of a system according to present invention. Starting at block 50, controller 40 establishes vapor flow by opening purge valve 34, provided necessary threshold conditions have been met. For example, vapor flow is usually not initiated when the engine is under cold operation as when it is being warmed up at a lower ambient temperature. Alternatively, purging may begin as soon as the engine is started.

Once the initial conditions are met and vapor flow has been established at an appropriate level at block 52, controller 40 moves to block 54, wherein purge system pressure $P_{SYS}$ is determined. The purge system pressure is periodically remeasured, and at block 56, the successively measured values of $P_{SYS}$ are used to calculate the time rate of change of $P_{SYS}$, which is identified as $\Delta P_{SYS}$.

At block 58, controller 40 finds the value $\Delta P_{MAX}$ which is representative of the maximum value of $\Delta P_{SYS}$ which engine 10 is capable of handling at a particular operating condition. $\Delta P_{MAX}$ may be based upon air flow through the engine. Alternatively, fuel flow may be employed for calculating $\Delta P_{MAX}$ by considering that when the engine is being operated at a high rate of fuel consumption, the perturbation caused by rapid excursions in the fuel content of the purge flow will be more easily tolerated. Other engine operating parameters or combinations of parameters known to those skilled in the art and suggested by this disclosure may be employed for the purpose of determining $\Delta P_{MAX}$.

Having determined $\Delta P_{MAX}$ at block 58, controller 40 moves to block 60 where $\Delta P_{MAX}$ is compared with $\Delta P_{SYS}$. In the event the $\Delta P_{SYS}$ is greater than $\Delta P_{MAX}$, controller 40 moves to block 62, wherein the flow of vapor to the engine is adjusted. It has been determined that it is frequently advisable in the event that engine 10 is operating at idle to either shut off or greatly reduce the flow of vapor to engine 10 for a period of time. The quantity of time for either shutting off or greatly reducing the purge flow may be based upon such parameters as the duration of time for which the engine has been operating since a cold startup, exhaust aftertreatment catalyst temperature, coolant temperature, or other engine operating parameters known into those skilled in the art and suggested by this disclosure.

If at block 60 the answer is no, processor 40 will return to block 54 and remeasure purge system fuel vapor pressure, calculate a new value for $\Delta P_{SYS}$, find a new value of $\Delta P_{MAX}$, compare $\Delta P_{MAX}$, and $\Delta P_{SYS}$, and so forth, to assure that engine 10 is not confronted with a situation where stable operation is impaired by a rapid change in air fuel ratio due to fuel vapor arising from either fuel tank 12 or carbon canister 14. This type of situation may occur when, for example, the fuel is warmed and the fuel tank is partially empty, which in turn may cause fuel to slosh on the wall of the tank and to flash into vapor, producing a considerable increase in the pressure in tank 12 and a corresponding increase in the flow of vapor into engine 10 past purge valve 34.

In another aspect of the present invention, in the event that the pressure trend detected by pressure transducer 32 changes in sign—in other words, changes from a positive slope indicating an increasing trend, to a negative slope, indicating a decreasing trend, processor 40 will immediately begin a new sample period. The same is true when the purge system pressure trend switches from a negative slope to a positive slope. In this manner, changes in vapor flow may be detected with less of a time lag, so as to allow more time to reduce purge flow without upsetting engine operation.

While the invention has been shown and described in its preferred embodiments, it will be clear to those skilled in the arts to which it pertains that many changes and modifications may be made thereto without departing from the scope of the invention.

We claim:

1. An evaporative emission control system for providing fuel vapor to an automotive engine, comprising:

a liquid fuel storage tank having an outlet port for allowing fuel vapor to exit the tank;

a carbon canister for storing fuel vapor generated within the fuel tank, with the carbon canister having an inlet port for receiving air and an outlet port, with the outlet port being adapted for both receiving fuel vapor from the fuel tank and acting an outlet for stored fuel vapor and air when the canister is purged;

a vapor line connecting the tank outlet port and the outlet port of the carbon canister;

a purge valve for allowing vapor to flow from the fuel tank and the outlet port of the carbon canister through a purge line and into the engine;

a pressure transducer for sensing a purge system pressure within the vapor line; and a controller connected with the purge valve and the purge system pressure transducer, with said controller tracking the purge system pressure within the vapor line within successive sample periods and operating the purge valve to restrict purging in the event that the time rate of change of the purge system pressure exceeds a threshold value.

2. A system according to claim 1, wherein said controller immediately begins tracking the purge system pressure during a new sample period in the event that the purge system pressure switches from a declining trend to an increasing trend.

3. A system according to claim 1, wherein said controller immediately begins tracking the purge system pressure during a new sample period in the event that the purge system pressure switches from an inclining trend to a decreasing trend.

4. A system according to claim 1, wherein the controller determines said threshold value for the time rate of change of purge system pressure as a function of the total mass of air flowing through the engine.

5. A system according to claim 1, wherein the controller determines said threshold value for the time rate of change of purge system pressure from a lookup table, using a measured value for the total mass of air flowing through the engine as an independent variable.

6. A system according to claim 1, wherein the controller determines said threshold value for the time rate of change of purge system pressure as a function of the fraction of fuel flowing through the engine which is furnished by said evaporative emission control system.

7. A method for controlling a flow of evaporative fuel vapor to an automotive engine having a liquid fuel storage tank, a carbon vapor storage canister, and a purge system for conveying fuel vapor to the engine from the fuel tank and the carbon canister, with said method comprising the steps of:

establishing a vapor flow from the fuel tank and carbon canister through the purge system and into the engine;

periodically measuring a purge system pressure within the purge system;

calculating the time rate of change of the measured purge system pressure; and adjusting the flow of purged vapor to the engine in the event that the calculated time rate of change of the purge system pressure exceeds a predetermined threshold.

8. A method according to claim 7, wherein the flow of vapor to the engine is terminated in the event that the time rate of change of purge system pressure exceeds a predetermined threshold.

9. A method according to claim 7, wherein said predetermined threshold is based upon a measured flow of fuel through the engine.

10. A method according to claim 7, wherein said predetermined threshold is based upon a measured flow of air through the engine.

11. A method according to claim 7, wherein the purge flow to the engine is terminated for a variable period of time in the event that the rate of change of purge system pressure exceeds a predetermined threshold, with the purge flow being reestablished after the variable period of time has run.

12. A method according to claim 7, wherein said controller immediately begins measuring the purge system pressure during a new sample period in the event that the purge system pressure switches from a declining trend to an increasing trend.

13. A system according to claim 7, wherein said controller immediately begins measuring the purge system pressure during a new sample period in the event that the purge system pressure switches from an inclining trend to a decreasing trend.

14. A system according to claim 7, wherein said controller immediately begins measuring the purge system pressure during a new sample period in the event that the trend of the purge system pressure changes sign.

* * * * *